US005137152A

United States Patent [19]

Ogose et al.

[11] Patent Number: 5,137,152

[45] Date of Patent: Aug. 11, 1992

[54] CONVEYOR BELT PACKING AND SHIPPING DEVICE

[75] Inventors: Akira Ogose; Ryouji Segawa; Kouji Hirano, all of Kobe, Japan

[73] Assignee: Bando Kagaku Kabushiki Kaisha, Kobe, Japan

[21] Appl. No.: 680,537

[22] Filed: Apr. 4, 1991

[30] Foreign Application Priority Data

Apr. 13, 1990 [JP] Japan ..... 2-39678[U]

[51] Int. Cl.[5] ..... B65D 85/66

[52] U.S. Cl. ..... 206/393; 206/389; 242/58.6; 410/42

[58] Field of Search ..... 206/393, 391, 389; 410/36, 42; 242/58.6

[56] References Cited

U.S. PATENT DOCUMENTS

| | | | |
|---|---|---|---|
| 2,144,600 | 1/1939 | Koonce | 206/391 X |
| 2,334,336 | 11/1943 | Lathrop | 410/42 |
| 2,335,516 | 11/1943 | Koonce | 206/391 X |
| 2,387,902 | 10/1945 | Hedges | 410/36 |
| 2,424,395 | 7/1947 | Hedges | 206/391 X |
| 2,721,653 | 10/1955 | Billinger | 206/393 |
| 2,918,342 | 12/1959 | Tarte, Jr. | 206/393 X |
| 3,017,021 | 1/1962 | Ruiz | 206/393 |
| 3,151,723 | 10/1964 | Wendt | 206/393 X |
| 3,388,792 | 6/1968 | Jones | 410/36 X |
| 3,476,238 | 11/1969 | Wright et al. | 206/393 |

*Primary Examiner*—Bryon P. Gehman

*Attorney, Agent, or Firm*—Marshall, O'Toole, Gerstein, Murray & Bicknell

[57] ABSTRACT

A packing device for transporting a long conveyor belt, and a conveyor belt wound over and across a pair of components of the packing device. The packing device has a pair of bobbins each comprising a take-up drum with radially extending discs fixed to both the ends thereof, and a long conveyor belt is wound over the respective bobbins with approximately the same turns on each bobbin. An opening for a shaft for rotation is provided in the center of each of the bobbins, and outwardly-directed ring-shaped flanges are provided around the circumference of each opening and in the periphery of each disc, respectively. The top ends of the ring-shaped flanges around the opening and in the periphery are bent towards each other, forming L-shaped portions in section.

9 Claims, 8 Drawing Sheets

CONVEYOR BELT PACKING AND SHIPPING DEVICE

FIELD AND BACKGROUND OF THE INVENTION

The present invention relates to a packing device for transporting a long conveyor belt, and a conveyor belt wound (for shipping) over and across a pair of components of the packing device, the components being in the shape of spectacles.

When a conveyor belt is used to transport, for example, coal, ore, cement, etc., the overall length of the conveyor belt is very long, for instance, several kilometers in ordinary circumstances. Hence a conveyor belt for such an application is produced by joining a number of conveyor belts of an appropriate length. Joining conveyor belts, however, takes much time. It, therefore, is desirable to use the longest possible conveyor belts so as to reduce the time required for joining the belts to a minimum. To meet this requirement, it is necessary to ship the longest possible conveyor belts from a manufacturer to a customer.

In the past, a shipping or packing device such as that shown in FIG. 10 has been used to transport a long conveyor belt. The device had a structure of a so-called bobbin 21 where radially extending discs 24 were fixed to both ends of a take-up drum 23 for a conveyor belt A, and an opening 25 for passing a shaft 28 therethrough was provided in the center of the discs 24 and through the drum 23. With the shaft 28 in place through the opening 25 of the discs 24, sling wires Y were placed over both ends of the shaft 28, and the bobbin 21 was lifted by a crane C or the like, by means of the sling wires Y, and then placed on a bed. Stoppers or blocks 27 were placed on both sides of the bottom of the bobbin 21 (the discs 24), and the bobbin 21 was fixed to a shipping pallet 29. After that, the sling wires Y were removed from the shaft 28, and the shaft 28 was taken out.

The above-mentioned conventional packing device had the following problems: (1) During packing and handling, it was necessary to put the shaft 28 through the opening 25 of the bobbin 21 and take out the shaft 28; such operations took much time and were very dangerous since the bobbin 21 could roll on the packing pallet. (2) Because the height (diameter) of the bobbin 21 is limited for transportation by the regulations governing roads, etc., the length of the conveyor belt was, in turn, limited by the maximum height of the bobbin 21.

SUMMARY OF THE INVENTION

The present invention was made in view of the above-mentioned points, and is intended to provide a packing device for a conveyor belt, and a conveyor belt wound in the configuration of a pair of spectacles, the packing device enabling packing and handling without the use of a shaft, resulting in a relatively simple and safe operation, and enabling transport of a longer (about twice) length of conveyor belt in comparison with the conventional packing device.

The packing device according to the present invention is a) a packing device for a conveyor belt having a pair of bobbins each comprising a take-up drum with radially extending discs fixed to both ends thereof and designed to pack a long conveyor belt by winding the conveyor belt over the respective bobbins with approximately the same number of turns, the structure having the configuration of a pair of spectacles, said packing device being characterized in b) that an opening for a rotatable shaft is provided in the center of each of said bobbins, c) that outwardly-directed ring-shaped flanges are provided around the circumference of each opening and in the periphery of each disc, respectively, and d) that the top ends of the ring-shaped flanges around the opening and in the periphery are bent towards each other, forming L-shaped portions in section.

It is desirable, to provide a plurality of connectors for joining, when said bobbins are placed abreast with the respective peripheral ring-shaped flanges thereof partly contacting with each other, spaced and opposing circular portions of said ring-shaped flanges with each other, and to provide, on both ends of each connector, a circular flange that can be aligned with the corresponding circular portion of said ring-shaped flange.

A packing device as described herein is for a conveyor belt, having a pair of bobbins each comprising a take-up drum with radially extending discs fixed to both ends thereof and being designed to pack a long conveyor belt in the form of a pair of spectacles by winding the conveyor belt over the respective bobbins with approximately the same number of turns, said packing device being arranged so that radially extending winding accessories can be disconnectably mounted on the peripheries of said bobbins.

A conveyor belt wound in the form of a pair of spectacles according to the present invention is wound over and across two bobbins in the form of a pair of spectacles formed by A) winding the long conveyor belt over a pair of bobbins each comprising a take-up drum with radially extending discs fixed to both ends thereof with approximately the same number of turns and B) bringing one bobbin close to the other bobbin with the peripheries thereof partially contacting each other.

In the aforementioned packing device according to the present invention, the ring-shaped flanges having the L-shaped section around the openings and in the peripheries of each of the paired bobbins serve as reinforcement members to improve the overall strength of the bobbins. Moreover, sling wires can be placed around the ring-shaped flanges, and the top-end bent portions of the ring-shaped flanges serve as a stopper to prevent the sling wire from slipping off. Thus the two bobbins can be simultaneously lifted by a crane or the like, without using a shaft, by placing sling wires around the ring-shaped flanges around the openings, to load on or unload from a bed or the like.

Winding a conveyor belt over a pair of bobbins in the form of a pair of spectacles is effected by, for example, first winding the total length of the conveyor belt over one bobbin, then taking up a part of the conveyor belt over the other bobbin so that the numbers of turns over both bobbins are virtually identical with each other, and bringing one bobbin close to the other so that the peripheral ring-shaped flanges of both bobbins partially contact with each other. In this way, when the conveyor belt is wound in the form of a pair of spectacles, the two bobbins lying side by side are connected by the conveyor belt spanning both bobbins. To take up a conveyor belt over a bobbin, a shaft is conventionally placed through the opening of the bobbin, and the shaft is turned together with the bobbin.

Further, the connectors as set forth herein are fitted across the opposing circular portions of the peripheral ring-shaped flanges of the pair of bobbins by aligning the circular flanges of the connectors with the peripheral circular flanges, and said circular portions of the ring-shaped flanges and said circular flanges are joined together with fittings. Because the pair of bobbins are firmly integrated by the connectors, the bobbins are unlikely to turn and topple. When the upper connectors are fastened together, and the lower connectors are fastened together, by connecting bars, the overall strength of the packing device is improved further. Moreover, when such connecting bars are placed on the outer side of the conveyor belt spanning the pair of bobbins, the conveyor can be protected from damage during transportation.

In a packing device according to the present invention, to wind a conveyor belt over a pair of bobbins, having the configuration of a pair of spectacles, ready for transport, the entire length of the conveyor belt (twice the length to be wound over one bobbin) is firstly taken up over one bobbin. Then a part (one half) of the conveyor belt wound over the bobbin is taken up over the other bobbin so that the numbers of turns over both bobbins are virtually identical to each other. During this operation, or when the entire length of the conveyor belt is wound over one bobbin and when a part of the conveyor belt wound over one bobbin is taken up over the other bobbin, winding accessories are mounted on the peripheries of one bobbin. The winding accessories will prevent irregular winding of the conveyor belt and guide the conveyor belt during winding and unwinding. When the conveyor belt is wound over both bobbins with approximately the same number of turns, the winding accessories may be removed from the bobbin to prepare the bobbins for transport.

In the aforementioned conveyor belt, the conveyor belt is wound over two bobbins with approximately the same turns. Thus the total length of the conveyor belt is about twice the length of a belt wound over one conventional bobbin. Furthermore, since the portion of the belt conveyor which spans across the bobbins operates as a connecting band for the two bobbins, the bobbins are integrated to prevent rolling and toppling of the respective bobbins.

DETAILED DESCRIPTION

With reference to the attached drawings, a preferred embodiment of a packing device for a conveyor belt according to the present invention is shown in FIGS. 1 to 7.

Figure 1:
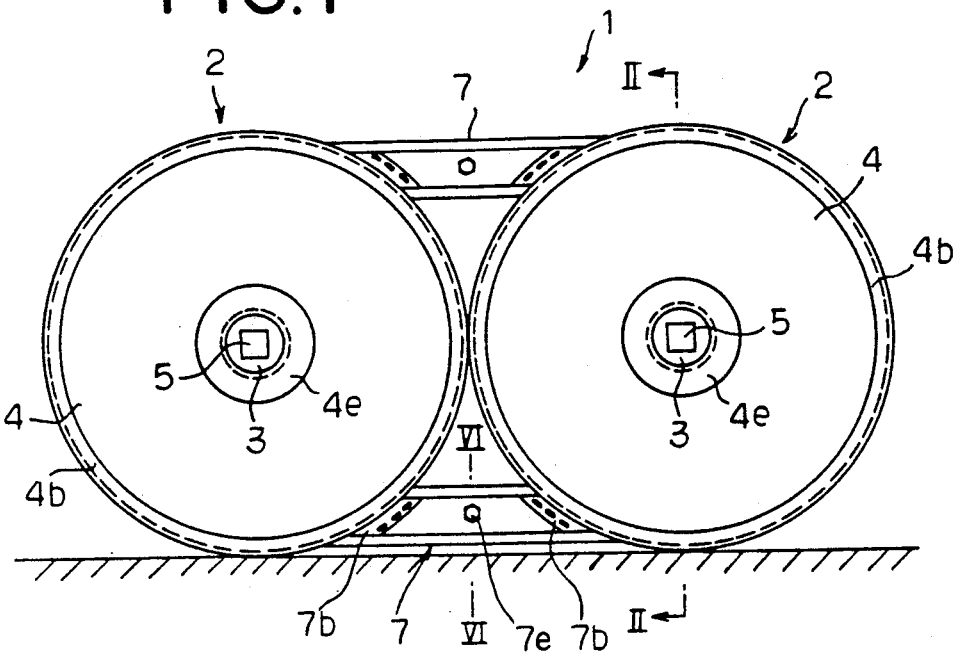
FIG. 1 is a front view of a preferred embodiment of a packing device for conveyor belt, according to the present invention.
Figure 2:
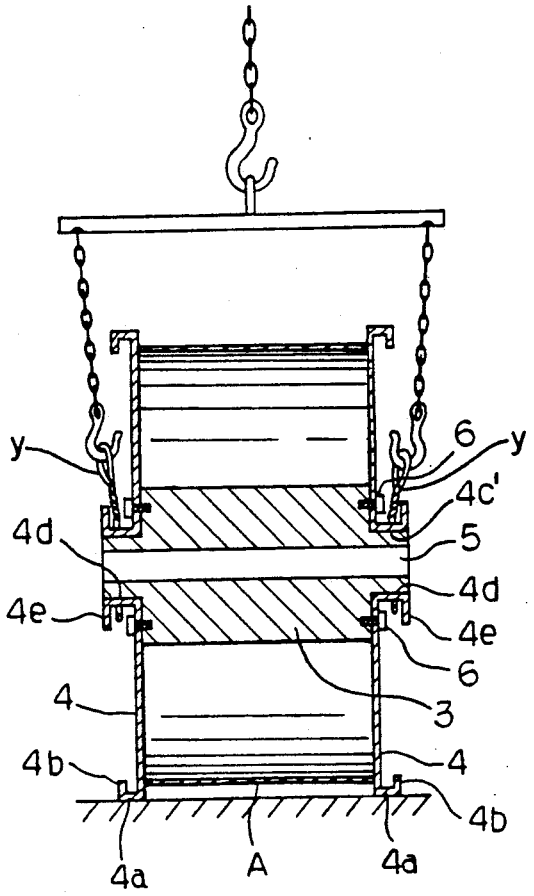
FIG. 2 is a sectional view along the line II—II of FIG. 1.

As shown in FIGS. 1 and 2, the packing device 1 of the present invention is provided with a pair of bobbins 2,2. Each bobbin 2 is structured such that the center opening 4*c* of a radially extending disc 4 is fitted on each end portion of a take-up drum 4 for taking up a conveyor belt A and the discs 4 are fixed to the drum 3 with bolts 6. A through hole 5 for receiving a shaft 8 (FIG. 7) for rotation with the drum is provided in the direction of the width in the axial center of the take-up drum 3 (the center axis of each bobbin 2). In the present embodiment, the cross-section of the through hole 5 is square. The associated shaft 8 is also shaped square in section except for both ends thereof, the ends being circular in section.

In the periphery of each disc 4 is provided a ring-shaped outwardly-directed flange 4*a*. The top end 4*b* of the ring-shaped flange 4*a* is bent inwardly in the radial direction to form an L-shaped section for the entire ring-shaped flange 4*a*. The circumference of the center opening 4*c* is also provided with an outwardly directed ring-shaped flange 4*a* projecting axially beyond the ring-shaped flange 4*a*. The outer end 4*e* of the ring-shaped flange 4*d* is similarly bent outwardly in the radial direction to form an L-shaped section to the entire ring-shaped flange 4*d*.

Figure 3:
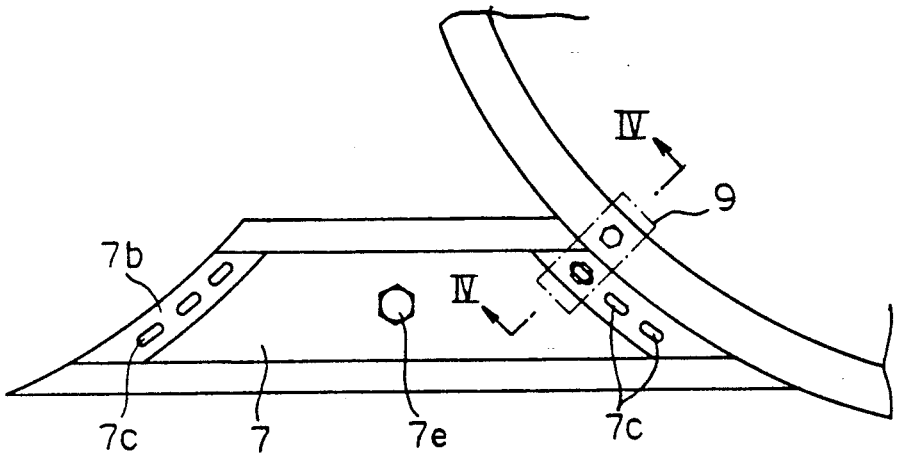
FIG. 3 is an enlarged view of one connector of the embodiment shown in FIG. 1.
Figure 6:
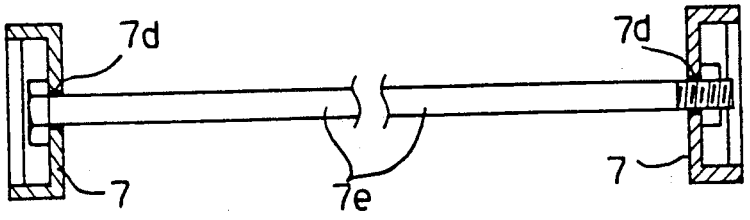
FIG. 6 is an enlarged sectional view taken along the line VI—VI of FIG. 1.
Figure 7A:
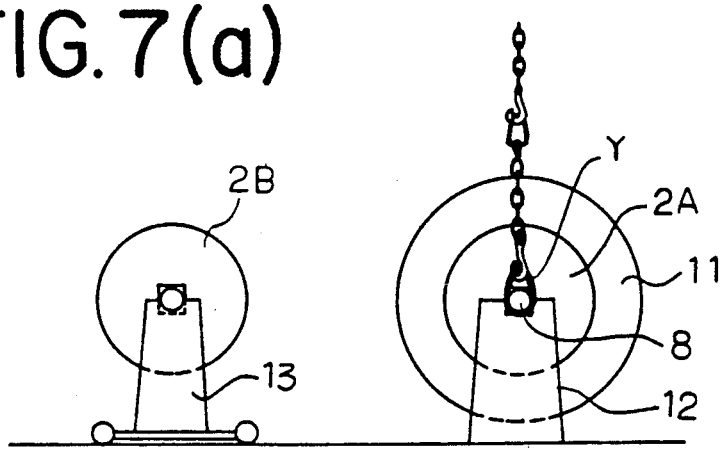
FIG. 7 (*a*) through 7 (*e*) are explanatory diagrams illustrating the work sequence of packing and handling with a packing device according to the present invention.
Figure 7B:
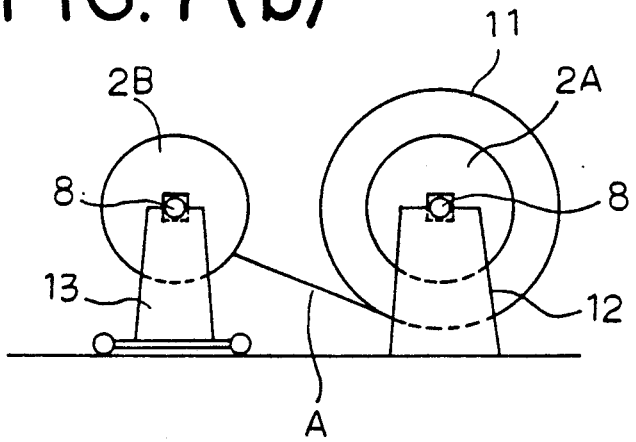
Figure 7C:
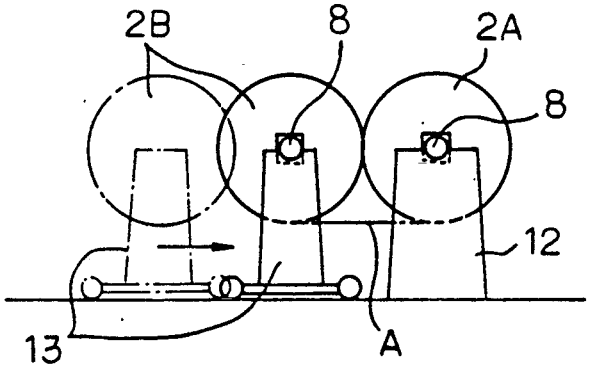
Figure 7D:
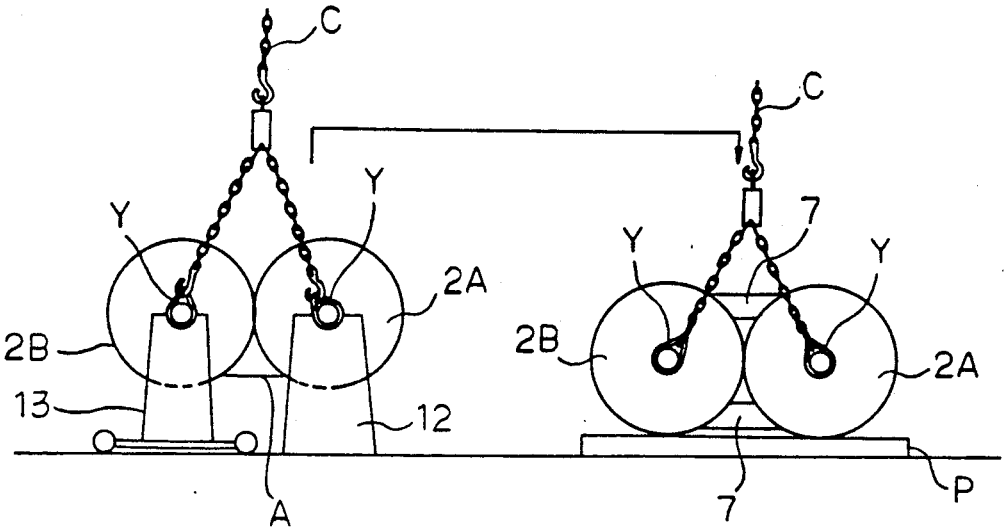
Figure 7E:
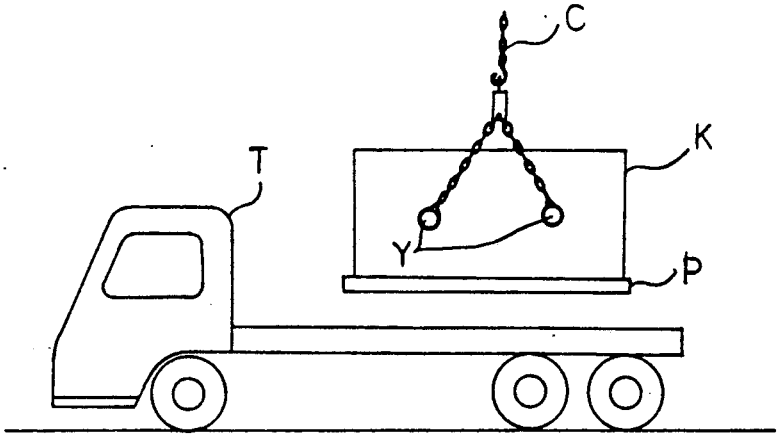

Each connector 7 for connecting the pair of bobbins 2,2 with each other is arranged, as shown in FIG. 1 and FIG. 3, so that, when the two bobbins 2,2 are placed abreast with the peripheral ring-shaped flanges 4*a* thereof partly contacting each other, each connector can be positioned across spaced and opposing circular portions of the ring-shaped flanges 4*a*. In other words, each end of each connector 7 is provided with an outwardly directed arcuate flange 7*a* that can be aligned with the corresponding circular portion of said ring-shaped flange 4*a*. Further the outer end 7*b* of each circular flange 7*a* is bent inwardly to form an L-shaped cross-section to the entire circular flange 7*a* . The outer end 7*b* of each circular flange 7*a* on both ends is provided, as shown in FIG. 3, with a plurality of spaced slots 7*c*. Further, each connector 7 is provided, near its center, with a through hole 7*d* (FIG. 6) for receiving a long 7*e* which forms a connecting rod. Thus, as shown in FIG. 6, the right-hand and left-hand connectors 7, 7 can be integrally connected by means of the long bolt 7*e*. Four connectors 7 are provided, there being an upper and a lower connector on each side of the assembly.

Figure 4:
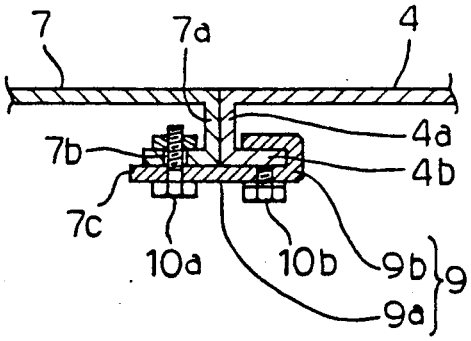
FIG. 4 is a sectional view along the line IV—IV of FIG. 3.
Figure 5:
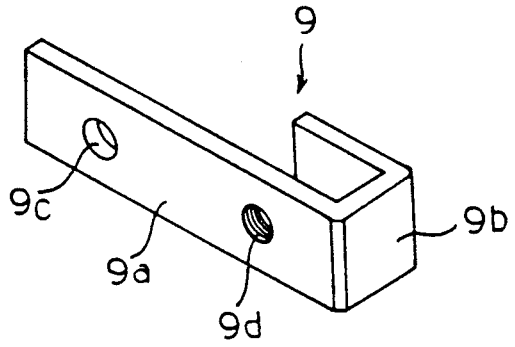
FIG. 5 is a perspective view of the fitting of the embodiment of FIG. 1;.

A fitting 9 for joining an arcuate flange 7*a* of a connector 7 and a peripheral ring-shaped flange 4*a* of a bobbin 2 is formed, as shown in FIG. 4 and FIG. 5, in a J shape in section. The elongated portion 9*a* of the fitting 9 is provided with a hole 9*c* for a bolt to be placed through one of the slots 7*c* and with a threaded hole 9*d* to be positioned on the ring-shaped flange 4*a* (circular portion) when the hook-shaped section portion 9*b* is fit over the ring-shaped flange 4*a* (circular portion). Numeral 10*a* denotes a bolt and a nut, and the bolt is inserted through the bolt hole 9*c* and a slot 7*c* in sequence. Numeral 10*b* denotes a bolt which is screwed into the threaded hole 9*d*. As the above-mentioned connector 9 is arranged for fitting over the peripheral ring-shaped flange 4*a* of the bobbin 2 and for putting the bolt 10*a* through a slot 7*c* of the circular flange 7*a* of the connector 7, the circular flange 7*a* of the connector 7 can be mounted at any desired position relative to the ring-shaped flange 4*a*.

Next, the procedure of packing and handling a conveyor belt A with a packing device 1 of the aforementioned embodiment will be described with reference to the attached drawings.

In FIG. 7 (*a*), a large-diameter ring-shaped plate mounted, as a radially extending winding accessory, on each periphery of one bobbin 2A. Then the bobbin 2A is loaded on a winding machine 12. This is effected by putting a shaft 8 through the hole 5 of the bobbin 2A, both ends of the shaft 8 being rotatably held by the winding machine 12. Both ends of the shaft 8 are circular in section as described above even for a shaft 8 which is otherwise square. The shaft 8 is rotated by a drive unit (not illustrated) of the winding machine 12 to take up a long conveyor belt A over the take-up drum 3 of the bobbin 2A (FIG. 2). Another shaft 8 is inserted through a hole 5 of the other bobbin 2B and the shaft 8 is rotatably mounted on a movable take-up cart 13 (FIG. 7 (*a*)).

One end of the conveyor belt A that has been taken up entirely on the bobbin 2A is attached to the take-up drum 3 of the bobbin 2B on the take-up cart 13, and the bobbin 2B is rotated by a drive unit (not illustrated mounted on the take-up cart 13) to rotate the bobbin 2B and take up the conveyor belt A (FIG. 7 (*b*)). During this operation, the drive unit of the winding machine 12 is used as a braking device.

When the number of turns of the conveyor belt A around the bobbin 2B reaches the number of turns of the conveyor belt A around the other bobbin 2A, the ring-shaped discs 11 on the bobbin 2A are removed. Then the take-up cart 13 is brought close to the winding machine 12 so that the ring-shaped flanges 4*a* on the peripheries of the bobbin 2B contact with the ring-shaped flanges 4*a* on the peripheries of the bobbin 2A. When the number of turns of the conveyor belt A over the bobbin 2A is virtually identical to that of the conveyor belt A over the bobbin 2B, or when the diameter of the conveyor belt A wound over the bobbin 2A is identical to that of the conveyor belt A over the bobbin 2B, the rotation of the bobbin 2B is terminated and the winding operation is completed (FIG. 7 (*c*)). The shafts 5 may then be removed.

Sling wires Y (FIGS. 2 and 7 (*d*) are put around the ring-shaped flanges 4*d* around the holes 5 of the bobbins 2A and 2B, and both the bobbins 2A and 2B are simultaneously lifted up by a crane C and loaded on a packing pallet P (FIG. 7 (*d*)). When the bobbins 2A and 2B are lifted by the crane C, the shafts 8 will be removed from the holes 5 of the bobbins 2A and 2B. After the bobbins 2A and 2B are loaded on the packing pallet P, the bobbins 2A and 2B are integrally connected with each other, at an upper point and a lower point on both sides, using a total of four connectors 7. In place of connectors 7, conventional stoppers or ropes may be used to fix the bobbins 2A and 2B on the packing pallet P. The bobbins are also secured to the pallet P.

The bobbins 2A and 2B on the packing pallet P are entirely enclosed with a packaging material K, and the bobbins 2A and 2B with the pallet are lifted again by the crane C with the sling wires Y and loaded onto the bed of a truck T. Thus the handling is completed (FIG. 7 (*e*)).

Figure 8:
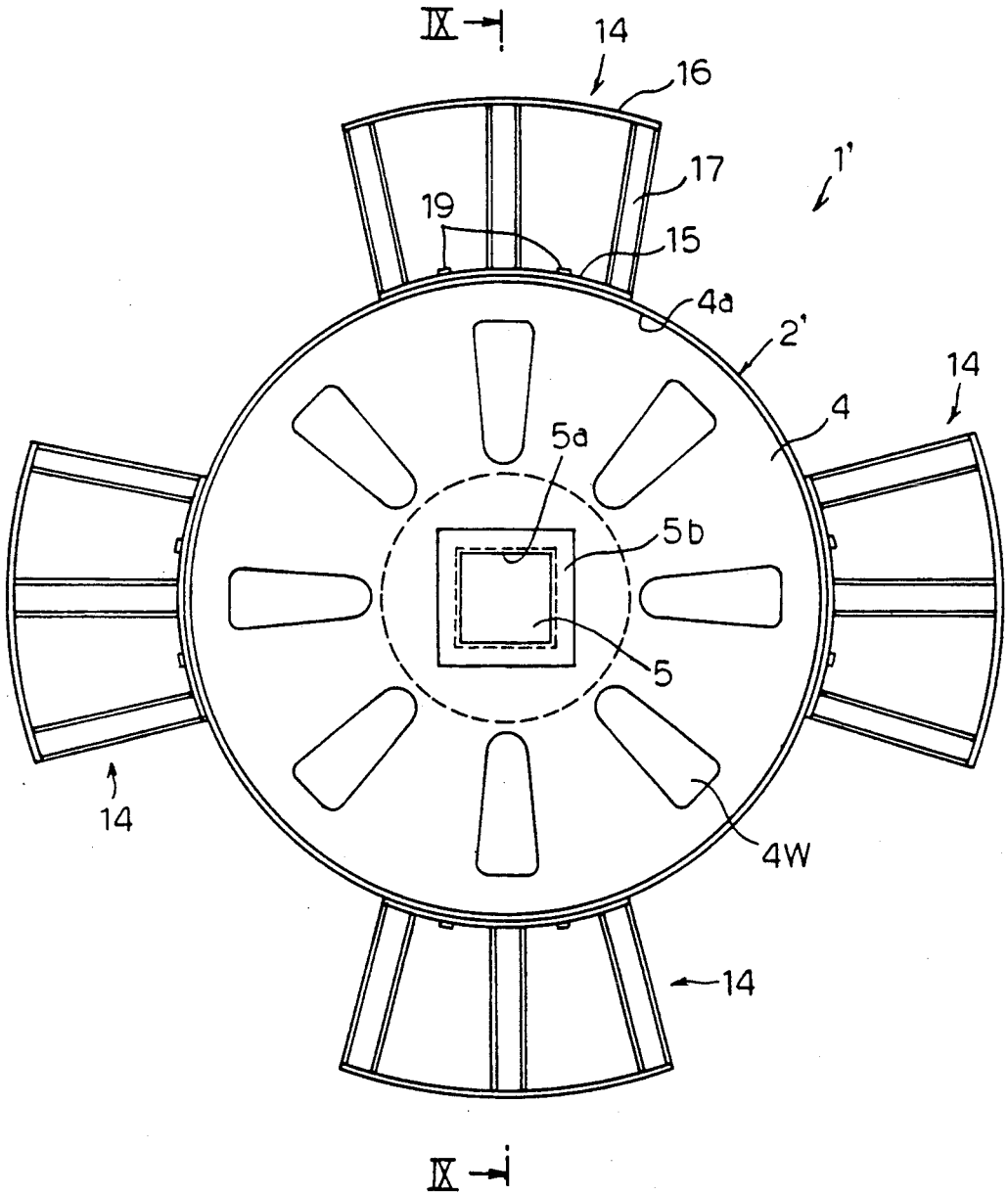
FIG. 8 is a front view showing one bobbin of a packing device according to an alternative embodiment of the present invention.
Figure 9:
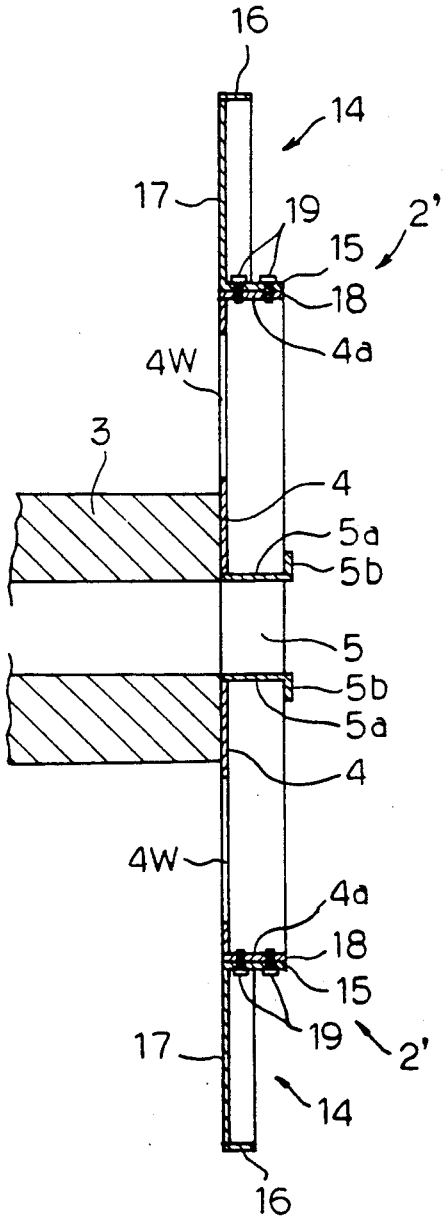
FIG. 9 is a sectional view along the line IX—IX of FIG. 8.
Figure 10:
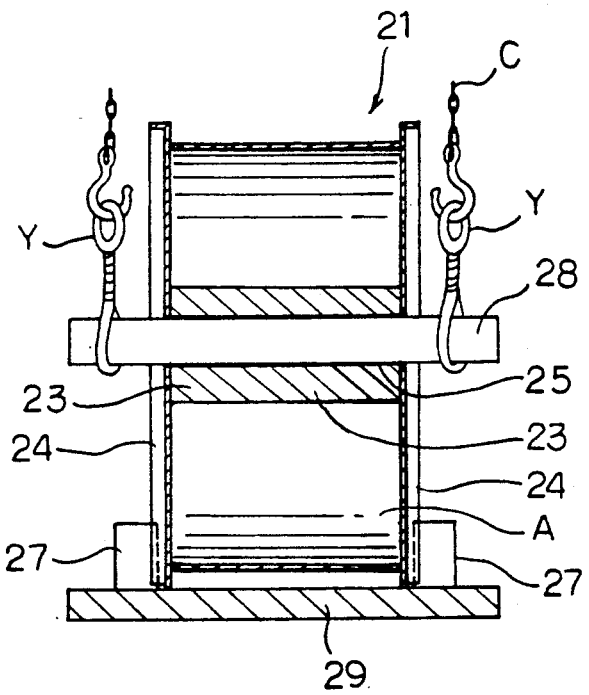
FIG.10 PRIOR ART
FIG. 10 is a central longitudinal sectional view showing a conventional packing device for conveyor belt.

FIG. 8 and FIG. 9 show another embodiment of a packing device according to the present invention.

In a bobbin 2' of the illustrated packing device 1', radially-extending discs 4 are secured to both ends of a take-up drum 3 for a conveyor belt A, and a through hole 5 for a shaft 8 (as shown in FIG. 7) is provided in the centers of the respective discs 4. An outwardly directed ring-shaped flange 4*a* is provided on the periphery of each disc 4. The circumference of each opening of the through hole 5 is provided with an outwardly directed flange 5*a*, and the outer end 5*b* of the ring-shaped flange 5*a* is bent outwardly in the radial direction. This configuration is mostly similar to the packing device according to the previously mentioned embodiment, except in the following points:

To reduce the weight, and to make it possible to externally check the conditions of winding and unwinding of the conveyor belt A, each disc 4 is provided with radial windows 4*w* spaced at intervals along the circumference. Instead of opening windows 4*w*, the entire disc 4 may be made of a fence-like structure.

Furthermore, in place of said ring-shaped plates 11, a plurality of roughly fan-shaped winding accessories 14 are provided, each accessory 14 comprising an inner circular flange 15 (FIG. 9) and an outer circular flange 16 connected together by a plurality of U-shaped-section fence members 17. The inner circular flange 15 of each winding accessory 14 and the ring-shaped flange 4*a* of the disc 4 onto which the accessory 14 is to be mounted are provided with a plurality of threaded holes 18 for bolts 19 so that the winding accessories 14 can be mounted on or dismounted from the ring-shaped flange 4*a* by tightening or loosening bolts 19 when necessary during winding or unwinding a conveyor belt A.

It should be noted that a packing device for a conveyor belt according to the present invention is mainly used for transporting a conveyor belt in a package; however, it may be used for transporting a conveyor belt without packing and for storing a conveyor belt.

As will be clear from the explanation above, the invention has the following advantages or effects;

(a) As each circumference of the through hole for a shaft in the center of each of a pair of bobbins, is provided with a ring-shaped flange, two bobbins can be lifted and moved simultaneously by a crane or the like by placing sling wires around the respective ring-shaped flanges without use of any shafts. Thus a packing device according to the present invention allows simpler packing and handling operations in a shorter time in comparison with the conventional packing device.

(b) As the pair of bobbins are placed abreast and connected together, the bobbins hardly roll and topple in comparison with a conventional packing device (single bobbin), assuring higher safety, and the length of a conveyor belt can be about twice that of the prior art arrangement. Thus longer conveyor belts can be handled.

(c) The pair of bobbins are connected with connectors. This assures higher reliability against rolling and toppling, resulting in a higher work handling.

(d) When a conveyor belt is to be wound over a bobbin more than an appropriate number of turns for the bobbin (normally twice the length), or such a conveyor belt is to be unwound from the bobbin, the winding accessories mounted on the peripheries of the bobbin prevent irregular winding of the conveyor belt and guide the conveyor belt.

(e) Since a conveyor belt wound in the form of a pair of spectacles has a length about twice that of a conventional conveyor belt wound over one bobbin, joining such conveyor belts, for example, to make a conveyor belt of several kilometers long will take about one-half of the time required for joining conventional conveyor belts. The reduced number of joints improves the overall strength of the conveyor belt. Furthermore, the portion of the conveyor belt spanning across the bobbins serves as a connector of the two bobbins, preventing rolling and toppling of the respective bobbins.

What is claimed is:

1. A packing device for a conveyor belt, comprising a pair of bobbins, each of said bobbins comprising a cylindrical take-up drum having a central axis and ends, radially extending discs fixed to said ends, each of said bobbins and said discs further including an opening therethrough on said axis for receiving a shaft, and each of said discs including axially outwardly-directed ring-shaped innner flanges formed around each of said openings, and the axially outer ends of said ring-shaped flanges being bent radially outwardly, thereby forming L-shaped portions in section, said pair of bobbins being in abreast positions wherein their axes are substantially parallel and said discs at each of said ends are substantially coplanar and closely adjacent each other.

2. A packing device for a conveyor belt as set forth in claim 1, and further including a long conveyor belt, approximately one-half of said belt being wound on one of said bobbins and approximately one-half of said belt being wound on the other of said bobbins, and said belt having an intermediate portion extending between said halves and said pair of bobbins.

3. A packing device for a conveyor belt as set forth in claim 1, wherein each of said discs further includes an axially extending ring-shaped outer flange around the outer periphery thereof, said outer flanges of said pair of bobbins contacting each other.

4. A packing device for a conveyor belt as set forth in claim 3, and further comprising a plurality of connectors for joining, when said bobbins are in said abreast positions with said outer flanges thereof partly contacting with each other, spaced and opposing portions of said ring-shaped outer flanges with each other, said connectors being provided with arcuate flanges which are aligned with and secured to said ring-shaped outer flanges of said pair of bobbins.

5. A packing device for a conveyor belt as set forth in claim 4, wherein said connectors are provided at both ends of said bobbins, and further comprising connection means extending substantially parallel said axes and coupling said connectors together.

6. A packing device as set forth in claim 4, and further including fittings securing said connectors with said outer flanges.

7. A packing device for winding a conveyor belt, comprising a pair of bobbins, each of said bobbins comprising a take-up drum having an axis and ends, radially extending discs fixed to both of said ends thereof, said bobbins being in abreast positions wherein said axes are substantially parallel and said discs at each of said ends are substantially coplanar, each of said discs having outer peripheries, and further including radially outwardly extending winding accessories disconnectably mounted on said outer peripheries of said discs of one of said bobbins.

8. A packing device as set forth in claim 7, and further including a long belt, approximately one-half of said belt being wound on one of said bobbins and approximately the remaining half of said belt being wound on the other of said bobbins, an intermediate portion of said belt extending between said bobbins.

9. Apparatus for winding a long conveyor belt, comprising a pair of bobbins, each of said bobbins comprising a take-up drum having a central axis and ends, radially extending discs fixed to both of said ends thereof, said bobbins being in abreast positions wherein said axes are substantially parallel and said discs at each of said ends are substantially coplanar, each of said discs having outer peripheries, said bobbins being placed close to each other with said peripheries of said discs partially contacting each other, a long conveyor belt, approximately one-half of said belt being wound on one of said bobbins and approximately the remaining half of said belt being wound on the other of said bobbins, an intermediate portion of said belt extending between said bobbins, connectors extending between said outer peripheries of said discs, and fittings securing said connectors to said outer peripheries of said discs.

* * * * *